United States Patent [19]

Greenway

[11] Patent Number: 4,670,317

[45] Date of Patent: Jun. 2, 1987

[54] PRODUCTION OF MATERIALS HAVING VISUAL SURFACE EFFECTS

[75] Inventor: John M. Greenway, Spartanburg, S.C.

[73] Assignee: Milliken Research Corporation, Spartanburg, S.C.

[21] Appl. No.: 682,880

[22] Filed: Dec. 18, 1984

Related U.S. Application Data

[63] Continuation of Ser. No. 517,563, Jul. 27, 1983, abandoned, which is a continuation of Ser. No. 253,135, Apr. 13, 1981, abandoned, which is a continuation-in-part of Ser. No. 103,329, Dec. 14, 1979, Pat. No. 4,499,637.

[51] Int. Cl.[4] ..... B32B 3/02

[52] U.S. Cl. ..... 428/89; 428/92; 428/97; 428/152; 428/187; 428/224; 428/229; 428/253

[58] Field of Search ..... 428/152, 212, 219, 85, 428/89, 92, 88, 95, 224, 225, 229, 253, 97, 187

[56] References Cited

U.S. PATENT DOCUMENTS

| | | | |
|---|---|---|---|
| 2,110,118 | 3/1938 | Robertson et al. | 26/2 R |
| 2,241,222 | 5/1941 | Sommers | 26/2 R |
| 2,373,194 | 4/1945 | Luttge | 28/78 |
| 2,563,259 | 8/1951 | Miller | 26/2 R |
| 2,875,504 | 3/1959 | White | 28/72 |
| 2,988,800 | 6/1961 | White | 28/72 |
| 3,010,179 | 11/1961 | Thal | 26/2 R |
| 3,613,186 | 10/1971 | Mazzone et al. | 26/2 R |
| 3,856,598 | 12/1974 | Gregorian et al. | 156/85 |
| 4,323,760 | 4/1982 | Greenway et al. | 26/2 R |
| 4,355,063 | 10/1982 | Palmer et al. | 428/89 |
| 4,418,451 | 12/1983 | Crenshaw | 428/89 |

FOREIGN PATENT DOCUMENTS

| | | | |
|---|---|---|---|
| 542584 | 5/1956 | Belgium | 428/89 |
| 766310 | 9/1971 | Belgium | 26/2 R |
| 906766 | 4/1962 | United Kingdom . | |
| 975491 | 11/1964 | United Kingdom | 428/89 |
| 1353183 | 5/1974 | United Kingdom . | |

*Primary Examiner*—James J. Bell

*Attorney, Agent, or Firm*—George M. Fisher; H. William Petry

[57] ABSTRACT

Method and apparatus for pressurized fluid stream treatment of the surface of a relatively moving substrate to impart visual surface changes thereto, and resulting products. The apparatus includes a fluid discharge manifold comprising an elongate compartment with discharge slot disposed across the path of relative movement of the substrate to discharge pressurized heated fluid, such as air, in one or more narrow discrete streams into the surface of a substrate, such as a textile fabric. A plurality of spaced, cooler air outlets are disposed in the discharge slot of the manifold to selectively direct pressurized cooler air across the slot in accordance with pattern information to block the heated air streams. The slot of the discharge manifold also may be provided with an elongate shim member having a plurality of spaced notches along a side edge for discharge of the heated fluid onto the surface of the substrate to form a desired pattern. The shim member may be employed in combination with the cooler air blocking outlets to provide more intricate patterning of the substrate.

The heated pressurized streams of air striking the surface of a thermoplastic textile material causes thermal modification, which may include longitudinal shrinkage of thermoplastic yarn and fiber components therein, to provide a patterned appearance to the material surface.

Also specifically disclosed are novel textile fabrics having patterned surface effects therein, and thermoplastic textile woven fabrics which are treated with the heated streams to provide a crepe or pucker appearance in the fabric.

12 Claims, 26 Drawing Figures

POLYPROPYLENE

DACRON™ POLYESTER TYPE 56 100/54 R-02 (DUPONT)

NYLON 6 (ENKA)

ORLON™ 1/24 BLEND 152 (DUPONT)

NYLON 6/6 TYPE 74S 500/92/0 (DUPONT)

ACRILAN™ (MONSANTO)

RAYON

ACETATE 70 DENIER

PRODUCTION OF MATERIALS HAVING VISUAL SURFACE EFFECTS

This application is a continuation of U.S. patent application Ser. No. 517,563, filed July 27, 1983, now abandoned, which in turn is a continuation of U.S. patent application Ser. No. 253,135, filed Apr. 13, 1981, now abandoned, which in turn is a continuation-in-part of U.S. patent application Ser. No. 103,329, filed Dec. 14, 1979, now U.S. Pat. No. 4,499,637.

This invention relates to improved method and apparatus for pressurized fluid stream treatment of relatively moving materials to provide visual surface effects therein, as well as to novel products produced thereby.

As used herein, the term "fluid" includes gaseous, liquid, and solid fluent materials which may be directed in a cohesive pressurized stream or streams against the surface of a substrate material. The term "gas" includes air, steam, and other gaseous or vaporous media, or mixtures thereof, which may be directed in a cohesive pressurized stream or streams. The term "substrate" is intended to define any material, the surface of which may be contacted by a pressurized stream or streams of fluid to impart a change in the visual appearance thereof. A thermally modifiable substrate is any material having a surface which may be modified in terms of shrinking, melting, or other physical change as a result of heat application.

Although substrates particularly suited for pressurized fluid stream treatment with the apparatus of the present invention are textile fabric constructions, and, more particularly, textile fabrics containing thermoplastic yarn and/or fiber components wherein pressurized heated fluid stream treatment of the surface of the fabric causes thermal modification of the yarns or fibers to produce a desired surface effect or pattern therein, the apparatus may be employed to treat any substrate wherein the nature of the pressurized treating fluid stream or substrate causes a visual change in the surface of the substrate due to contact by the stream. For example, the treating fluid may be a solvent for the substrate material, or the temperature of the fluid may be such as to thermally modify or deform the components of the substrate contacted by the fluid streams to produce such effects.

As used herein, the term textile fabric is intended to include all types of continuous or discontinuous webs or sheets containing fiber or yarn components, such as knitted, woven, tufted, flocked, laminated, or nonwoven fabric constructions, in which pressurized heated fluids may impart a change in the visual surface appearance of the fabric. Melt spun fibers or yarns comprise polyester, polyamide, or polyolefin components. Solution spun fibers or yarns comprise acrylonitrile, urethane, and cellulose based fibers such as rayon, cellulose acetate, and cellulose triacetate. Of these, materials comprised of polyester, polyamide, polyolefin, acrylonitrile, cellulose acetate, cellulose triacetate, and urethane, or combinations thereof, are considered thermoplastic. It is foreseen that materials not included in the above list can be shown to be thermoplastic or otherwise thermally modifiable using the method and apparatus of this invention; the above list should not, therefore, be considered exhaustive. Further, it is foreseen that other substrates which are not usually considered textile fabrics, such as sheet foam substrates, may be used advantageously, and are to be considered as a textile material for use in connection with this invention.

BACKGROUND OF THE INVENTION

It is known to impart a surface pattern to certain acrylic pile fabrics by roll embossing, wherein the pile surface is brought into engagement with raised surfaces of the roll to press heated pile fibers into the backing of the fabric and transfer the roll surface pattern into the fabric surface. However, such roll embossing of heated pile fabric products is quite expensive because a different pattern roll is required for each different pattern to be applied to the fabric, and the length of a pattern repeat in the fabric is limited by the circumference of the pattern roll. Furthermore, roll embossing acrylic fabric to achieve a pattern which is resistant to repeated washing, or steaming, is extremely difficult. The process of hot roll embossing melt spun thermoplastic yarn fabrics, such as nylon and polyester fabrics, can be difficult because of the care which must be exercised in controlling the temperatures required to sufficiently soften and heat-set these melt spun yarns, and the resulting tendency for sticking of the yarns to the embossing roll.

It is known in the dyeing of fabrics to pattern dye a moving fabric by the use of continuously flowing liquid streams of dyestuff which are selectively deflected away from striking the fabric by intersecting streams of air controlled in accordance with pattern information. U.S. Pat. Nos. 3,969,779 and 4,059,880 discloses apparatus used for such purpose.

It is generally known to employ apparatus to direct pressurized air or steam into the surface of textile fabrics to alter the location of or modify the thermal properties of fibers or yarns therein to provide a change in the surface appearance of such fabrics. U.S. Pat. No. 3,010,179 discloses apparatus for treating synthetic pile fabrics by directing a plurality of jets of dry steam from headers onto the face of the moving fabric to deflect and deorient the pile fibers in areas contacted by the steam, and the fabric is thereafter dried and heated to heat-set the deflected fibers and provide a visual effect simulating fur pelts. U.S. Pat. No. 2,563,259 discloses a method of patterning a flocked pile fabric by directing plural streams of air into the flocked surface of the fabric, before final curing of the adhesive in which the fibers are embedded, to reorient the pile fibers and produce certain pattern therein. U.S. Pat. No. 3,585,098 discloses apparatus for hot air or dry steam treatment of the pile surface of a fabric to relax stresses in the synthetic fibers and cause a disorientation and curing of the fibers throughout the fabric. U.S. Pat. No. 2,241,222 discloses apparatus having a plurality of jet orifices for directing pressurized air or steam perpendicularly into a fluffy fabric surface to raise and curl the nap or fluff of the fabric. U.S. Pat. No. 2,110,118 discloses a manifold having a narrow slot for directing pressurized air against the surface of a fabric containing groups of tufts to fluff the tufts during a textile treating operation. U.S. Pat. No. 3,613,186 discloses apparatus for sculpturing a pile fabric using a set of individual jets of heated air.

Although the patents mentioned in the preceding paragraph indicate generally that pressurized air and steam may be employed to alter the surface appearance of fabrics, it is believed that such prior art devices do not possess sufficient accuracy and precision of control of high temperature gas streams to obtain highly precise and intricate surface patterns with well defined boundaries, but generally can only be used to produce relatively grossly defined surface patterns, or surface fiber modifications of a random, non-defined nature. In addition, the apparatus appear to be limited as to the nature and variety of different patterns that can be produced, and as to the fabrics used therewith.

In modifying the surface appearance of a relatively moving substrate, such as a textile fabric, by application of streams of fluid, many difficulties are encountered in controlling the flow, pressure, and direction of the streams with sufficient reliability and accuracy to impart precisely defined and intricate patterns to the textile fabric. In addition to preciseness of pattern definition, difficulties are presented in effectively handling very high temperature fluids while maintaining a uniform temperature in the fluid streams across the width of a moving fabric, as well as in controling rapid activation and deactivation of heated streams by conventional valves located in the heated fluid flow lines. Also, contaminants in the heated fluid can easily block and clog small individual jet orifices of a pressurized fluid applicator, resulting in down time of the treating apparatus to clear the blockage, and loss of fabric product due to improper patterning by the apparatus during such blockage.

OBJECTS OF THE INVENTION

It is therefore an object of the present invention to provide method and apparatus for more reliable and precise surface patterning of substrate materials with pressurized fluid streams than heretofore believed obtained by prior apparatus and methods.

It is another object of the invention to provide improved method and apparatus for the pressurized, high temperature fluid stream treatment of the surface of substrate materials containing thermoplastic components to impart a change in the surface appearance or contour thereof.

It is a more specific object to provide improved method and apparatus for directing precisely defined streams of a high temperature, pressurized gas into the surface of a textile fabric containing thermoplastic yarns or fibers to thermally modify the thermoplastic yarns in the fabrics and produce a desired surface pattern therein which is relatively permanent with respect to repeated washing or abrasion.

It is another object to provide improved method and apparatus for treating pile fabrics containing thermoplastic pile yarns or fibers with selectively directed streams of heated gas to longitudinally shrink the yarns and produce a precisely defined surface pattern therein.

It is a further object to provide improved method and apparatus for treating textile woven fabrics containing thermoplastic yarn or fiber components with selectively directed streams of heated gas to provide a novel patterned crepe or blister effect in the fabrics.

It is another object to provide improved method and apparatus for heating undyed fabrics containing thermoplastic yarns or fibers subsequently dyed after treatment, as well as previously dyed fabrics containing thermoplastic yarns or fibers, with selectively directed streams of heated gas to cause a difference in perceived color or light reflectivity between the treated and untreated portions of the fabric.

It is another object to provide method and apparatus for uniformly raising the pile yarns of a pile fabric having a predominantly uni-directional pile yarn lay in the fabric. Difference. It is a further more specific object to provide improved method and apparatus for directing one or more narrow streams of high temperature gas generally perpendicularly into the surface of a textile fabric to thermally alter the characteristics of thermoplastic fibers and yarns therein, while selectively blocking passage of the streams or portions thereof with cooler pressurized gas streams in accordance with pattern information to impart various surface patterns thereto.

It is another object to provide certain novel fabric products produced by the method and apparatus of the present invention.

BRIEF DESCRIPTION OF THE DRAWINGS

The above as well as other objects of the invention will become more apparent from the following detailed description of preferred embodiments of the invention, when taken together with the accompanying drawings, in which.

BRIEF DESCRIPTION OF THE INVENTION

Figure 1:
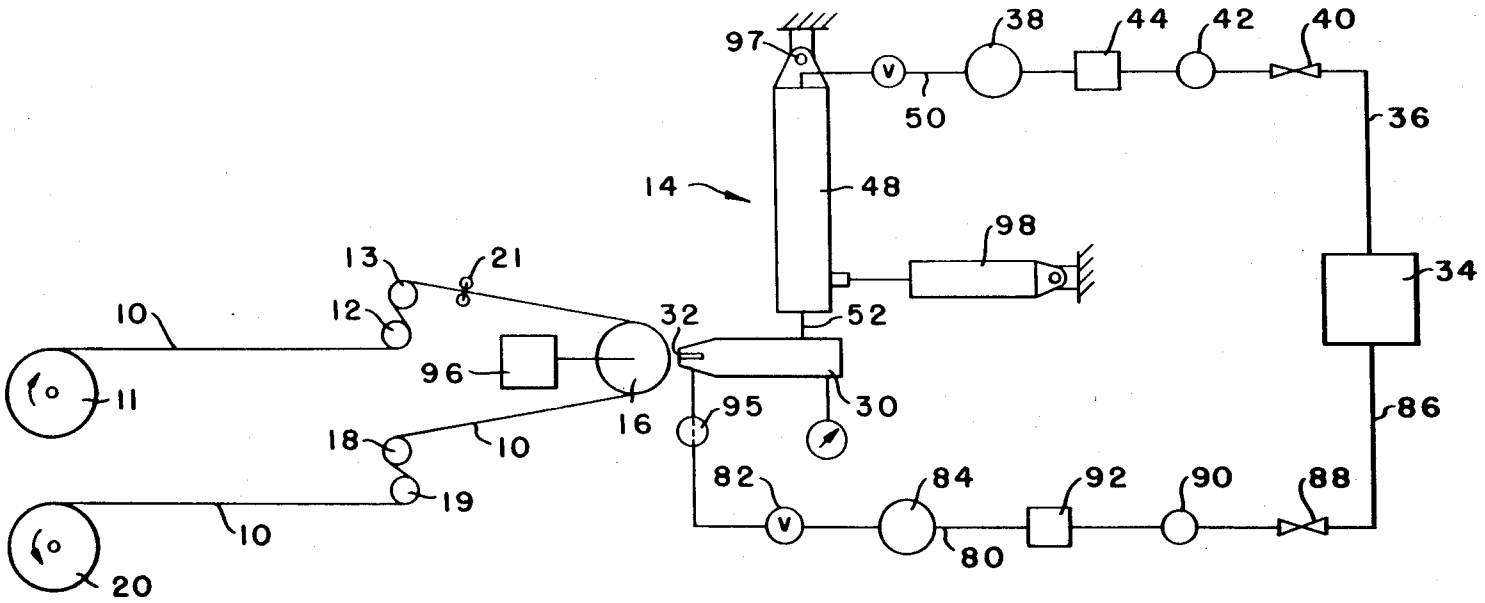
FIG. 1 is a diagrammatic, overall, side elevation view representation of apparatus for imparting visual surface effects in a moving substrate in accordance with the present invention.

In its broad aspects, the present invention comprises improved method and apparatus for the accurate and high speed application of a pressurized stream or streams of pressurized fluid to the surface of a relatively moving substrate to impart a change in the visual surface appearance therein. More particularly, the apparatus includes a heated fluid distributing manifold having a narrow elongate slot disposed across the path of relative movement of the substrate and located closely adjacent the surface to be treated. Pressurized fluid, such as air, heated to 300°–1000° F., or more commonly, 600°–900° F., is supplied to the manifold and directed from the slot into the surface of the moving substrate, while the discharge of the hot air from the slot is controlled to direct the air in one or more narrow, precisely defined streams which impinge upon the substrate to impart a desired surface change therein. Higher temperatures can be used, if desired. The heated air striking the substrate, in the case of substrates comprising textile fabrics containing thermoplastic yarns or fibers, causes thermal modification of the thermoplastic fibers and yarn components in the fabric and alters the physical appearance thereof. In addition to considerable fiber or yarn re-orientation, compaction and entanglement, the hot air in many cases causes dramatic longitudinal shrinking of the fibers and yarns in selected areas to form permanent patterns having precise boundaries, and often imparts an apparent color change to the fabric in those selected areas. Where the fabric or other substrate is comprised principally of non-thermoplastic fibers or yarns, for example, rayon, the visual effect is primarily the result of fiber or yarn re-orientation or compaction, and the effect is not completely permanent. Substrates in the form of foams may be used as well.

In one embodiment of the invention, heated fluid, such as air, is selectively directed into precisely defined streams by the use of an elongate shim member having notches selectively spaced along an edge of the shim member, with the notched edge of the shim member disposed in the manifold slot along its length to define spaced channels for directing the air into narrow plural streams and onto the surface of the relatively moving substrate. The shim member is further constructed to provide for filtration of foreign particles from the air to prevent clogging of the channels while maintaining continued flow of the air streams therethrough.

In a further embodiment, the treating apparatus includes means for selectively directing pressurized, relatively cooler gas streams transversely into the manifold slot at spaced locations therealong to effectively block the passage of hot air striking the substrate in such locations, in accordance with pattern control information. The pressurized cool gas discharge means includes suitable valves for individually controlling the flow of each of the blocking streams of cool gas, such as air; the cooler gas blocking means may be employed in the manifold slot with or without the aforementioned shim members to selectively pattern the substrate surface in accordance with pattern information.

The invention further includes fluid handling means for maintaining uniform distribution of the heated fluid across the full length of the manifold and manifold slot, thus ensuring more accurate and precise heat patterning of the substrate thereby.

The high temperature fluid treatment method and apparatus of the present invention is suited to produce novel surface patterns of highly precise boundary definition in pile fabrics containing melt-spun thermoplastic pile yarns, which patterns are not heretofore believed to have been produceable with heated fluid treatment apparatus of the prior art. Surface patterns may also be imparted to pile fabrics containing solution-spun thermoplastic type yarn components, such as acrylic yarns. In addition, surface patterns may be imparted to non-thermoplastic type yarn components, such as rayon, although the patterns obtained generally do not appear as permanently defined, i.e., as resistant to washing or abrasion, as in the patterning of thermoplastic yarn-containing fabrics. In either case, these surface patterns may take the form of changes in relative texture, in pile height, in perceived color, or a combination thereof. The method and apparatus may also be employed on dyed, nonpile fabrics containing thermally modifiable fiber or yarn components to produce a surface pattern effect which is perceived as a change in color or light reflectivity in the treated area resulting in a multi-tone effect, and may also include a substantial change in the texture of the treated area as well. Fabric treatment may be carried out prior to dyeing to obtain subsequent differential dye uptake in the thermally modified and non-modified fibers and yarns, again producing a multi-tone effect. Further, the method and apparatus may be employed to selectively treat woven fabrics containing thermoplastic yarns to provide novel crepe or blister-type patterns in such fabrics.

The invention further includes a method for uniformly raising the pile yarns of a pile fabric having an initial unidirectional pile yarn inclination by application of a heated gas stream into the pile surface while relatively moving the fabric in a direction generally opposite to the direction of inclination of the pile yarns.

Although the apparatus of the present invention is particularly adapted to treatment of textile fabrics containing thermoplastic fiber and yarn components to provide various visual surface effects therein, it is contemplated that the apparatus may be used in fluid treatment of other substrate materials, for example, thermoplastic and non-thermoplastic foams, to thermally alter their visual appearance or provide a desired pattern therein.

DETAILED DESCRIPTION OF EMBODIMENTS OF THE INVENTION

Referring more particularly to the drawings, which illustrate preferred embodiments of apparatus as well as certain novel fabric products of the present invention, FIG. 1 is a schematic side elevation view of the overall treating apparatus of the present invention. As shown diagrammatically, an indefinite length of substrate material, such as a textile fabric 10, is continuously directed from a supply source, such as roll 11, by means of driven, variable speed feed rolls 12, 13 to a pressurized heated fluid treatment device, indicated generally at 14. The moving fabric 10 is supported during application of heated fluid thereto by passage about a support roll 16, and the fluid treated fabric is thereafter directed by driven, variable speed take-off rolls 18, 19 to a fabric collection roll 20.

A conventional fabric edge-guiding device 21, well known in the art, may be provided in the fabric path between feed rolls 12, 13 and the fluid treating device 14 to maintain proper lateral alignment of the fabric during its passage over support roll 16. The speed of the feed rolls 12, 13, support roll 16, and take-off rolls 18, 19 may be controlled, in known manner, to provide the desired speed of fabric travel and the desired tensions in the fabric entering, passing through, and leaving the fluid treating device 14.

Figure 2:
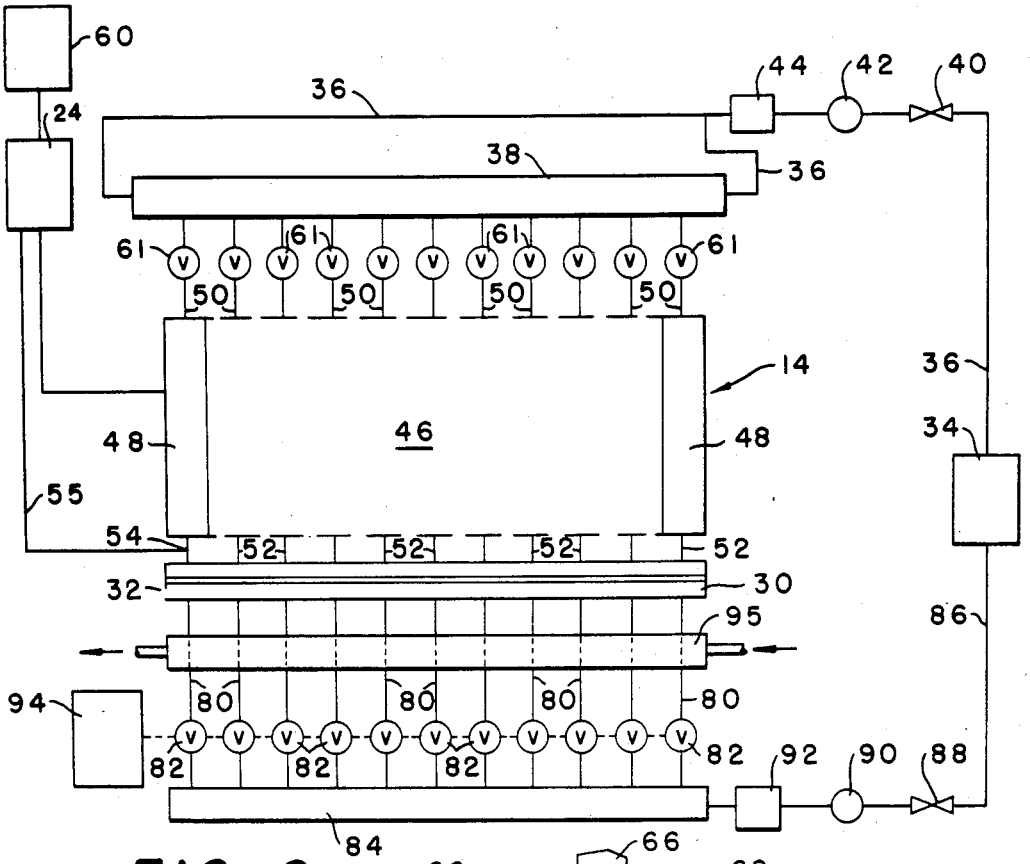
FIG. 2 is an enlarged diagrammatic front elevation view of the pressurized heated fluid applicator section of the apparatus of FIG. 1, illustrating an arrangement of the component parts thereof for supplying both heated and relatively cool pressurized gas to a hot gas distributing manifold of the applicator.

As illustrated in FIGS. 1 and 2, pressurized fluid treating device 14 includes an elongate heated gas discharge manifold 30 which extends perpendicularly across the path of movement of fabric 10 and has a narrow, elongate discharge slot 32 for directing a stream of pressurized heated gas, such as air, into the surface of the fabric and at an angle generally perpendicular to the surface during its movement over support roll 16.

Pressurized gas, such as air, is supplied to the interior of the discharge manifold 30 by means of an air compressor 34 which is connected by air conduit line 36 to opposite ends of an elongate cool air manifold, or header pipe, 38. Located in the air conduit line 36 to control the flow and pressure of air to manifold 38 is a master control valve 40, and an air pressure regulator valve 42. A suitable air filter 44 is also provided to assist in removing contaminants from the air passing into air manifold 38.

Pressurized air in the air manifold 38 is directed from manifold 38 to hot air discharge manifold 30 through a bank 46 of individual electric heaters, only two of which, 48, are illustrated in FIG. 2. Each heater is connected by inlet and outlet conduits 50, 52 respectively, positioned in uniformly spaced relation along the lengths of the two manifolds 38, 30 to heat and distribute the air from manifold 38 uniformly along the full length of the discharge manifold 30. The bank of heaters 48 may be enclosed in a suitable insulated housing and the air outlet conduit 52 of each heater is provided with a temperature sensing device, such as a thermocouple, the position of one of which, 54, is shown in FIG. 2, to measure the temperature of the outflowing air. The thermocouples are electrically connected by wiring (illustrated by line 55 in FIG. 2) to a conventional electrical recorder/controller 58 where the temperature can be observed, monitored, and electric current supplied as required to individual of the heaters from a power source, generally indicated at 60, to maintain the outlet air temperatures from the heaters uniform across the discharge manifold 30. Such electrical recorder/controllers are believed to be well known and readily available in the art, and details thereof are not described herein.

To simplify the maintenance of uniform temperature of the air exiting from each of the outlet conduits 52 of each of the heaters 48, and to eliminate the necessity and expense of individually monitoring and regulating the electrical power to each heater 48 in the heater bank 46, the pressurized air inlet conduit 50 to each heater may be provided with a needle control valve 61 which may be manually adjusted to individually and precisely control the amount of air supplied to each electrical heater from air manifold 38. By the use of such needle valves, electrical power may be uniformly supplied to all of the heaters in the bank, and any initial variations in the outlet air temperatures from the heaters "balanced" to uniformity by incremental adjustment of the needle valves. Thereafter, the temperature in the outlet conduit of only one of the heaters, or at one location in the heated air manifold, need be monitored to regulate electrical power supply to the entire bank of the heaters, in mass. The provision and use of the individual needles valves to vary the flow of pressurized gas through the individual heater units to initially balance exit air temperatures from the heaters is not my independent invention, but is a preferred embodiment which forms the subject matter of a joint invention described and claimed in a commonly assigned copending U. S. patent application to Greenway and Bylund, Ser. No. 103,255, filed Dec. 13, 1979.

Figure 3:
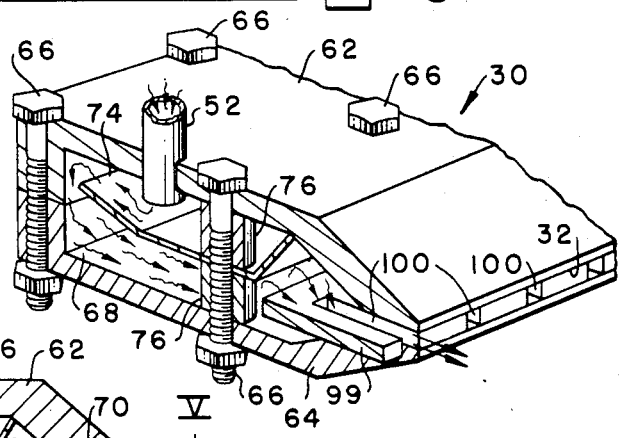
FIG. 3 is an enlarged schematic perspective view of a portion of the hot gas distributing manifold of FIGS. 1 and 2, with portions broken away and shown in section to illustrate certain of the interior components and a shim member employed in the elongate slot of the manifold to impart a desired surface pattern to the relatively moving substrate.
Figure 4:
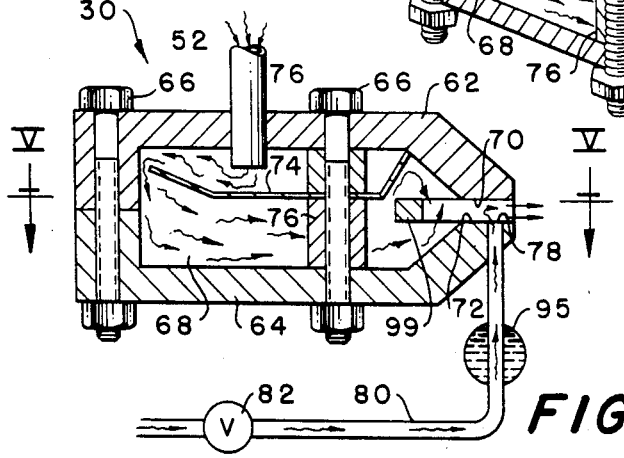
FIG. 4 is a schematic sectional elevation view of the heated gas distributing manifold of FIG. 3, and additionally showing the use of pressurized cooler gas distribution means for selectively blocking portions of the heated gas from exiting from the manifold to produce a patterned appearance in the substrate.
Figure 6:
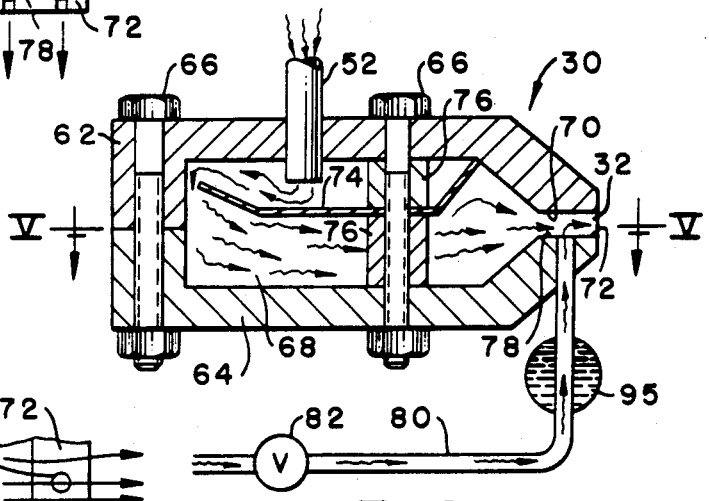
FIG. 6 is a schematic sectional elevation view of a modified form of the hot gas manifold, with shim member removed from the hot gas distributing slot of the manifold and with only the cooler gas distributing means employed to control the hot gas discharge from the slot.

As best seen in FIGS. 3, 4, and 6, heated air discharge manifold 30 is formed of upper and lower wall sections 62, 64 which are removably secured together by suitable fastening means, such as spaced bolts 66, to form the interior compartment 68 of the manifold as well as opposed parallel walls 70, 72 of the elongate discharge slot 32.

Prior to discharge through slot 32, heated air passing into the compartment 68 of manifold 30 from the outlet conduits 52 of the bank of heaters 48 is directed rearwardly and then forwardly in a reversing path through the manifold compartment (as indicated by the arrows) by means of a baffle plate 74 which forms a narrow elongate opening rearwardly in compartment 68 for passage of the air from the upper to the lower portion of the compartment. Baffle plate 74 thus provides for more uniform distribution of the air in the manifold compartment and further facilitates the maintenance of uniform air temperature and pressure in the manifold. Baffle plate 74 is supported in manifold compartment 68 by spacer sleeves 76 surrounding bolts 66.

As best seen in FIGS. 4–7, located in the wall surface 72 of lower wall section 64 of the manifold and positioned in spaced relation along the length of the discharge slot are a plurality of cool air discharge outlets 78. Each outlet is individually connected by a suitable flexible conduit 80 and solenoid valve 82 to a cool air manifold 84, which is in turn connected to air compressor 34 by conduit 86 (FIG. 2). Located in conduit 86 is a master control valve 88, air pressure regulator valve 90, and air filter 92.

As diagrammatically illustrated in FIG. 2, each of the individual solenoid valves is electrically operatively connected to a suitable pattern control device 94 which sends electrical impulses to open and close selected of the solenoid valves in accordance with predetermined pattern information. Various conventional pattern control devices well known in the art may be employed to activate and deactivate the valves in desired sequence. Typically, the pattern control device may be of a type described in commonly assigned U.S. Pat. No. 3,894,413.

As illustrated in FIGS. 4 and 6, each of the cool air discharge outlets 78 is located in the lower wall surface 72 of the manifold slot 32 to direct a pressurized discrete stream of relatively cool air transversely into the heated air discharge slot in a direction perpendicular to the passage of heated air therethrough. The pressure of the cooler air streams is maintained at a level sufficient to effectively block and stop the passage of heated air through the slot in the portion or portions into which the cold air streams are discharged. Actually, the effect is possibly due to a combination of blocking and dilution of the heated air stream, depending on the relative pressures of the respective heated and cool air streams, but the term blocking will be used for simplicity. Thus, by activation and deactivation of the individual streams of cool air by the solenoid valves 82 in accordance with information from pattern control device 94, pressurized heated air passing through the slot will be directed in one or more distinct streams to strike the moving fabric surface in a desired location, thus providing a pattern effect in the surface of the fabric 10 as it passes the discharge manifold. The cooler air which blocks the passage of the heated air passes out of the slot in place of the heated air to dissipate around or into the fabric surface without altering the thermal characteristics of the fabric or appreciably disturbing the yarns or fibers therein. Note the arrows indicating air flow in FIGS. 4, 6, and 7. To ensure. that the cooler blocking air is maintained sufficiently cool so as not to effect or thermally modify the fabric, the ambient air may be additionally cooled prior to discharge across the manifold slot 32 by provision of a cool water header pipe 95 through which the cool air conduits 80 pass.

Although cool pressurized air blocking means, as specifically described herein, is preferred for controlling discharge of the heated pressurized gas streams, it is contemplated that other type blocking means, such as movable baffles, or the like, may be employed in the elongate slot 32 to selectively prevent passage of the heated pressurized air into the fabric.

To prevent possible bowing or warping of the fabric support roll 16 due to differential heating of its circumference by contact of one side of the roll by the high temperature gas from the manifold discharge slot 32, the interior of the roll 16 may be provided with a circulating heat transfer fluid, such as water, from a supply source 96. The circulating fluid thus facilitates uniform heat transfer about the circumference, particularly when the fabric feed is momentarily stopped. The provision of such heat transfer fluid in roll 16 is not my sole independent invention, but forms subject matter of the invention of aforesaid Greenway and Bylund copending application Ser. No. 103,255.

Additional improvements to the apparatus disclosed herein are described in detail in the following two pending U.S. patent applications filed Jan. 23, 1981, which are hereby incorporated by reference herein. U.S. Ser. No. 227,828 discloses the construction and arrangement of the manifold housings to minimize distortion of the housings caused by differential thermal expansion. U.S. Ser. No. 227,838 discloses heated air outlets which communicate with the manifold compartment to continuously bleed off heated air, thereby counteracting localized cooling of the manifold adjacent the discharge channels and reducing pressure buildup when selected channels are blocked with cool air.

To avoid damage to the fabric by the presence of heated gas when the fabric feed is stopped, the hot gas manifold 30 and its heaters 48 are pivotally supported, as at 97, and fluid piston means 98 utilized to pivot the manifold and its discharge slot away from the path of the fabric 10.

FIG. 3 illustrates a first form or embodiment of the heated pressurized gas discharge manifold of the present invention wherein an elongate shim member or plate 99 having a plurality of elongate generally parallel notches 100 uniformly spaced along one edge of the plate is removably positioned in the manifold compartment 68 with its notched side edge extending into the elongate discharge slot 32 to form with the walls 70, 72 of the slot a plurality of corresponding heated air discharge channels for directing narrow discrete streams of pressurized heated gas onto the surface of the moving textile fabric. As seen in FIGS. 3 and 4, the notches 100 of the plate extend into the heated gas manifold compartment 68 to form an elongate inlet above and below the plate into each of the discharge channels formed by the notched edges of the shim and the walls 70, 72 of the manifold slot 32. Thus the shim plate not only serves to direct pressurized gas into narrow streams to be discharged through the spaced channels, but the edges of the shim plate defining the uppcr and lower openings of the narrow, elongate inlets (note FIG. 4) serve to trap and filter out foreign particles which may be present in the pressurized gas, while permitting continued flow of pressurized gas around the particles and through the channels.

Figure 8:
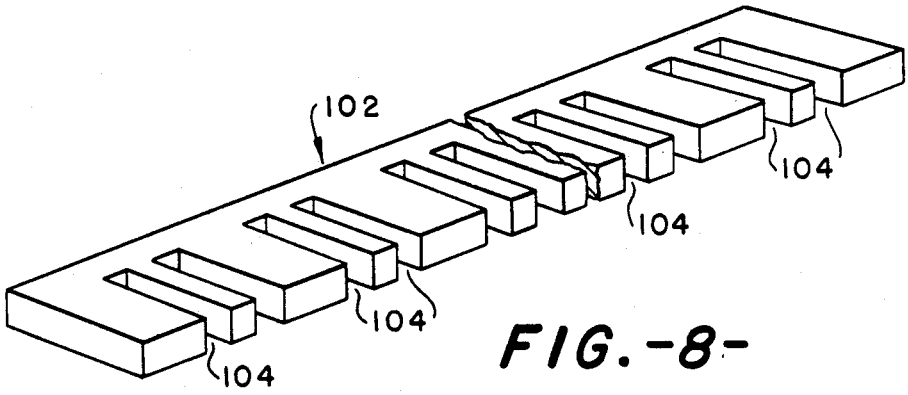
FIG. 8 is an enlarged schematic perspective view of a shim member employed with the hot gas manifold to distribute the gas in narrow spaced streams onto the surface of a substrate.

It can thus be understood that the discharge channels formed by the shim member and discharge slot direct a plurality of discrete, individual spaced streams onto and into the surface of the moving textile fabric to form narrow, spaced, generally parallel lines extending in the direction of movement of the fabric past the discharge manifold. For example, by maintaining the temperature and pressure of the heated gaseous streams at sufficient levels and by an appropriate choice of air discharge channel size and substrate speed, pile fabrics containing thermoplastic pile yarns contacted by the heated gas streams may be made to longitudinally shrink and compact in the pile surface, and may be heat set to form continuous distinct grooves in the fabric, thereby permitting patterning of the surface of the fabrics in various ways, some of which will be hereinafter described. To change the grooved pattern in the fabric, it is only necessary to loosen the manifold bolts 66 and replace an existing shim plate with another shim plate having a different groove size and/or spacing along the shim plate edge. FIG. 8 illustrates another shim plate 102 having an irregular shim notch 104 spacing along the plate to provide a variation in the pattern which may be applied to the surface of the fabric web. Thus it can be seen that various surface patterns may be applied to the moving web by the shim plates alone, and without the additional control of the streams by the cooler pressurized gas outlets described above.

The surface patterns to be imparted to the surface of the desired textile material is not limited to grooves or combinations of grooves. Relatively large areas may be thermally treated to produce a wide variety of surface effects. A puckered or crepe appearance may be permanently imparted to the surface of woven or knitted thermoplastic fabrics. In addition, it has been found that a multi-tone effect may be achieved with a variety of pile and non-pile fabrics.

Fabric treament may be carried out prior to dyeing to obtain subsequent differential dye uptake in the thermally modified and non-modified fibers and yarns, producing multi-tone dye effects, patterning effects, or both in pile as well as non-pile fabrics. When fabric treatment is carried out after the substrate has been dyed, a multi-tone patterning effect may also be achieved. When the patterning effect is due to the shrinking or shriveling of individual fibers and yarn segments as with non-pile fabrics and some pile fabrics, those fibers and yarn segments tend to increase in diameter, becoming shorter but thicker, and tend to lose apparent bulk in terms of crimp within the treated area. This in turn tends to increase the apparent density of dye-bearing fibers or yarns in the area of the fabric actually treated, and makes this area appear to have a color value which is more saturated, intense, or visually darker, the degree depending upon choice of operating conditions Example 9 gives some representative values. This result is unexpected; similar fabrics treated with a heated embossing roll are visually lighter in the areas of roll contact.

In some cases, as described in Example 12 involving a pile fabric, a two tone effect may be achieved by permanently reorienting the predominant direction of the fibers comprising the pile, without appreciably shrinking those fibers. Where the heated air stream lays down or entangles fibers which normally are relatively straight and are viewed in a more-or-less "end-on" orientation, the effect can be a lightening or dilution of the color observed in the treated areas, when compared to areas on the fabric which have not been treated. The untreated fibers remain relatively upright causing the eye to see many more fibers in a substantially on-axis orientation, and causing more shadowing of the individual fibers than is found when the fibers are permanently inclined or entangled by the hot air stream, resulting in a darker color.

Figure 5:
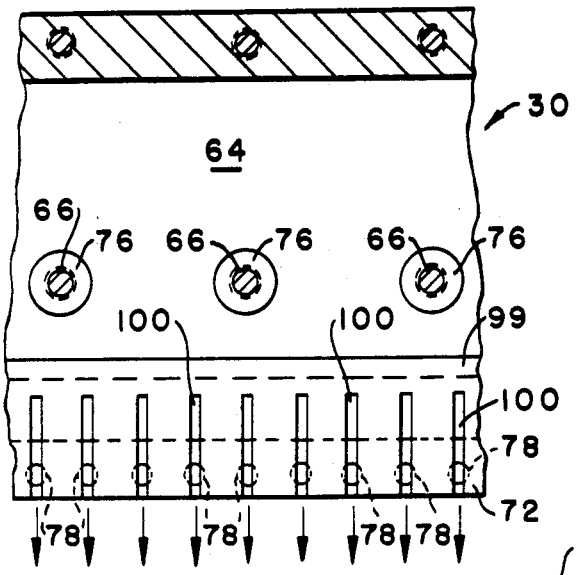
FIG. 5 is a schematic sectional view of a portion of the hot gas distributing manifold shown in FIG. 4, taken generally along line V—V of FIG. 4 and looking in the direction of the arrows.

FIGS. 4 and 5 illustrate a form of the invention wherein shim plates are employed in combination with the pressurized cooler gas outlets in the discharge slot 32 to form more intricate or detailed patterns in the textile web. As seen in FIG. 5, the discharge outlets 78 are located in the channels formed by the shim plate and slot walls 70, 72 to selectively block the channels with cool gas and thereby permit intermittent discharge of selected of the heated gas streams to produce surface patterns which may vary across the fabric as well as in the direction of movement of the fabric past the discharge manifold.

Figure 7:
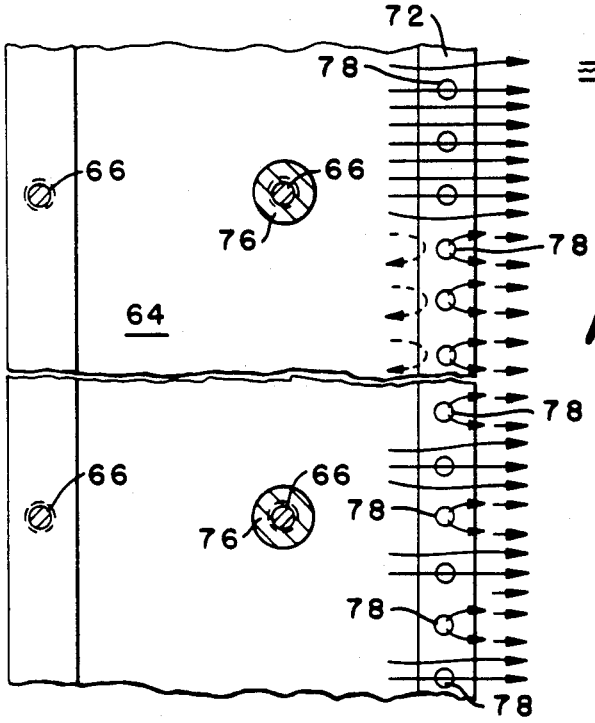
FIG. 7 is a schematic sectional view of portions of the manifold of FIG. 6, taken generally along line VII—VII therein, and looking in the direction of the arrows.

FIGS. 6 and 7 illustrate another form of the invention wherein patterning of the fabric is accomplished by use of the elongate slot 32 and pressurized cool gas outlets without the use of shim plates. As seen in FIG. 7, by selectively activating the cool gas stream supply to certain of the outlets 78 in accordance with pattern information, the heated gas passage through slot 32 is blocked by the cooler gas in corresponding areas of the slot to pattern the moving fabric.

The pressurized heated gas discharge manifold of the present invention also may be employed to uniformly raise the thermoplastic pile yarns of a pile fabric having a generally uniform unidirectional pile lay, such as pile fabrics produced by cutting or slitting of the pile yarns of a double backed knit fabric construction to form two pile fabric sheets. In such a method of pile fabric production, the pile yarns of the two fabric sheets are generally uniformly inclined in a direction opposite the direction of the fabric movement during the cutting operation.

Figure 9:
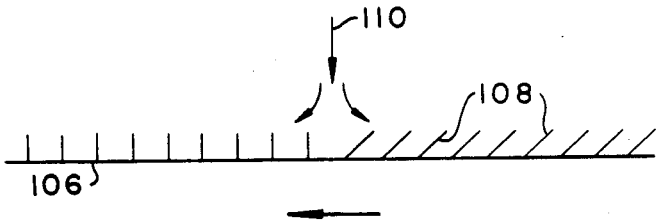
FIGS. 9 and 10 illustrate schematically the method by which the treating apparatus of the invention may be employed to raise the pile of a textile pile fabric substrate having a generally unidirectional pile yarn lay in the fabric.
Figure 10:
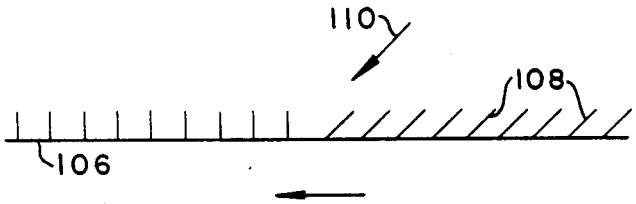

As schematically illustrated in FIGS. 9 and 10, it has been found that when a unidirectionally inclined pile fabric is passed by the narrow elongate discharge slot 32 of manifold 30 in a direction of travel opposite to the direction of inclination of the pile yarns, surprisingly the inclined pile yarns are brought into an upright erect position generally perpendicular to the surface of the pile fabric, and the heated gas stream striking the fabric surface heat sets the pile yarns in such disposition. FIGS. 9 and 10 illustrate the pile fabric substrate 106, the pile yarns 108, their direction of inclination therein, and the direction at which the heated gas stream 110 strikes the pile surface. As illustrated, it is preferable that the gas stream 110, as illustrated by the arrows, strike the fabric surface at an angle of approximately 90° or greater to the direction of fabric movement in order to effect the upright uniform setting of the pile yarns. If the fabric is passed in a direction other than a direction opposite the direction of inclination of its pile yarns, or the pressurized stream of gas is directed other than within the angles mentioned, the pile yarns do not become uniformly erect but are either further inclined or randomly disoriented in the pile fabric surface.

The use of the apparatus of the present invention to carry out certain of the processes described and claimed herein may be further understood by the followings specific examples setting forth operating conditions in treatment of textile fabrics containing yarn components to produce a desired surface appearance or pattern therein. The examples are by way of illustration only, and are not intended to be limiting on the use of the apparatus of the present invention. Where reference is made to cool air pressure, that pressure was measured at cool air manifold 84, as seen in FIGS. 1 and 2.

EXAMPLE 1

A knit polyester plush pile fabric having a weight of thirteen ounces per square yard and a pile yarn height of one tenth of an inch was continuously fed through the apparatus illustrated in FIG. 1 at a speed of fabric travel of five yards per minute. The temperature and pressure of the heated air in the discharge manifold compartment was maintained at 600° F. and 6 p.s.i.g., respectively. The discharge slot of the manifold was maintained at a distance of approximately 0.050 inch from the pile surface and was provided with a shim plate having a notched configuration, as illustrated in FIG. 3. The spaced discharge channels formed in the slot were of rectangular cross-sectional dimension of 0.011 in. wide by 0.062 in. high. The length of each channel through the slot was 0.250 inch and the channels were spaced on 0.2 inch centers across the manifold.

Figure 11:
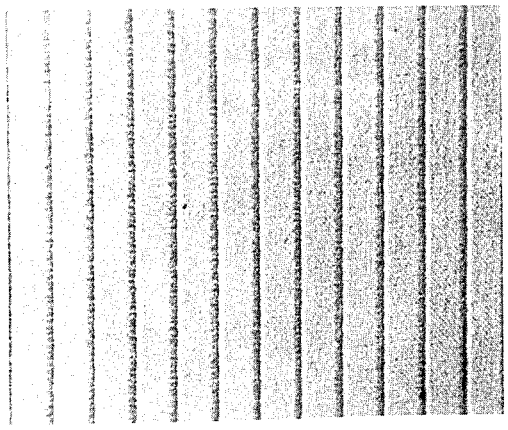
FIGS. 11–16 are photographs of the surface of certain novel textile fabric products treated by and produced in accordance with apparatus and methods of the present invention.

The heated streams of gas striking the pile surface of the fabric caused longitudinal shrinkage of the pile yarns in the areas of contact to lower and compact them into the fabric forming narrow, elongate distinct grooves extending along the path of movement of the surface. Pile yarns adjacent the sides of the grooves remained substantially unmodified and undistrubed to form distinct upright side walls of the grooves. The fabric had a pattern surface appearance as illustrated by the photograph of the fabric in FIG. 11 of the drawings.

EXAMPLE 2

A polyester plain weave fabric having a fabric weight of three and one-half ounces per square yard, and a 92 warp end by 84 pick end per inch fabric construction, was processed through the apparatus of FIG. 1 at a fabric speed of four yards per minute and with a 12 percent overfeed of the fabric between rolls 12, 13 and rolls 18, 19. The support roll 16 was overdriven during fabric passage thereover. Heated air temperature and pressure, and discharge channel size and spacing in the manifold was the same as in Example 1.

Figure 12:
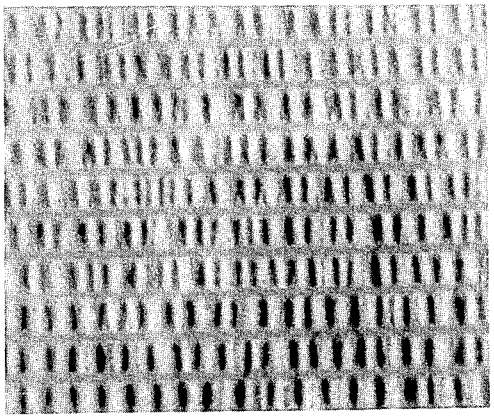

The high temperature pressurized gas streams striking the fabric overfed onto the support roll in warp direction caused longitudinal thermal shrinkage of the warp yarns contacted thereby continuously along their length. Intermediate portions of the fabric between the lines containing yarns which were thermally unshrunk assumed a crepe or pucker appearance, as illustrated by the photograph of the fabric in FIG. 12 of the drawings.

EXAMPLE 3

Figure 13:
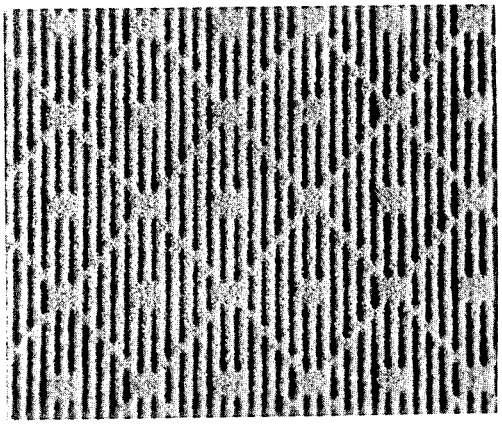

A pile fabric construction as defined in Example 1 was processed through the treating apparatus of FIG. 1 at a proccss speed of two yards per minute. Heated air temperature in the manifold was maintained at 700° F. and at a pressure of 2 p.s.i.g. Utilizing a fabric speed of two yards per minute, the heated air discharge channels of a shim plate as in Example 1, but spaced at 0.1 inch centers, were selectively blocked by pressurized cooler air streams from the cool air outlets in the manifo1d slot in accordance with pattern information. A cool air pressure of 12 p.s.i.g. was maintained in the cool air manifold. The treated fabric possessed a pattern composed of a series of narrow distinct, well defined grooves, as illustrated in the photograph of the fabric shown in FIG. 13.

EXAMPLE 4

Figure 14:
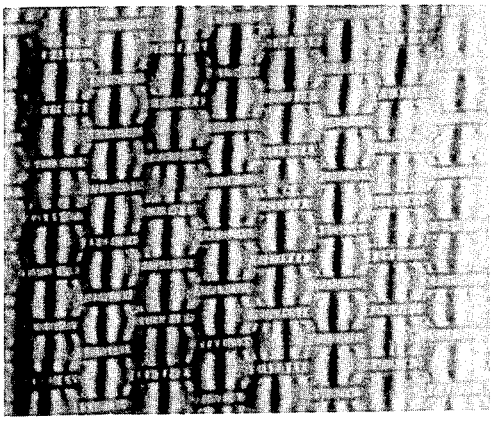
Figure 15:
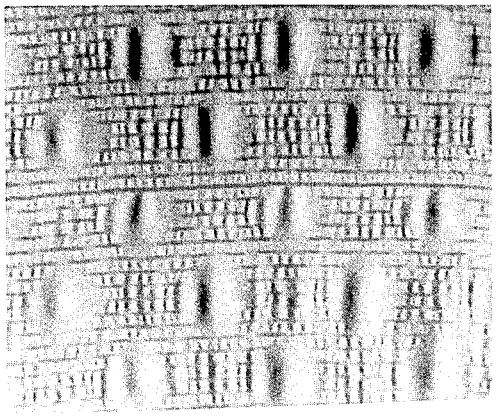

Two polyester woven fabric constructions as described in Example 2 were treated in accordance with the conditions and with cool air pattern control means of Example 3 to cause thermal shrinkage of the warp yarns at spaced locations along the direction of the movement of the fabric. The resultant fabrics, according to pattern information supplied thereto, possessed a pucker and blister appearance, as shown in the respective photographs in FIGS. 14 and 15 of the drawings.

EXAMPLE 5

A plush velvet polyester pile fabric in undyed and unheat-set form and having a construction as defined in Example 1 was processed on the appratus as shown in FIG. 1 at a processing speed of four yards per minute. The pile fabric has a unidirectional pile yarn inclination and was moved past the uninterrupted discharge slot of the hot air manifold in a direction opposite to the direction of inclination of the pile yarns in the fabric, as illustrated in FIGS. 9 and 10. Heated pressurized air at a temperature of 300° F. in the manifold and a pressure of 1½ p.s.i.g. was continuously directed against the moving pile surface at a right angle thereto. The height of the manifold discharge slot was 0.016 inches. The air stream striking the pile surface of the fabric raised the pile to a generally uniform, upright perpendicular position relative to the pile surface and backing of the fabric. The processed fabric exhibited a uniform, upright pile surface appearance.

EXAMPLE 6

A knitted nylon plush pile fabric and a knitted acrylic plush pile fabric, each having a weight of approximately 12 ounces per square yard and a pile height of a 0.1 inch, were each treated on the apparatus of FIG. 1 and under process conditions and with shim plate configuration as described in Example 1. The processed nylon pile fabric exhibited a well defined, distinct pattern of surface grooves, with pile yarns which were contacted by the heated air streams being longitudinally shrunken into the backing of the fabric. The acrylic fabric also possessed a grooved surface pattern, but of less distinct appearance and groove definition than the melt spun thermoplastic yarn fabrics.

EXAMPLE 7

A knitted acrylic plush pile fabric having a weight of approximately 12 ounces per square yard and a pile height of 0.1 inch, was treated on the apparatus of FIG. 1 under the following conditions: heated air temperature in manifold—710° F.; heated air pressure in manifold—1.5 p.s.i.g.; cool air pressure—9 p.s.i.g.; manifold to fabric spacing—0.1 inch; fabric speed—5 yards/minute, 1% underfeed; and heated air discharge channel size—0.050 in. wide, 0.015 in. high (facing fabric).

Figure 16:
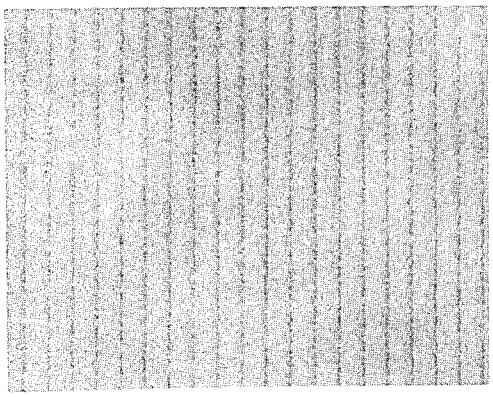
Figure 17:
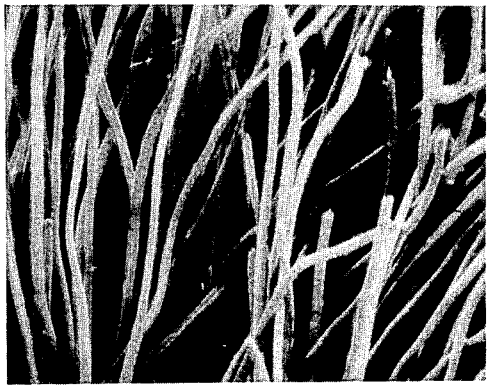
FIGS. 17 and 18 are photomicrographs of surface portions of the novel textile acrylic fabric of FIG. 16 produced in accordance with the present invention.
Figure 18:
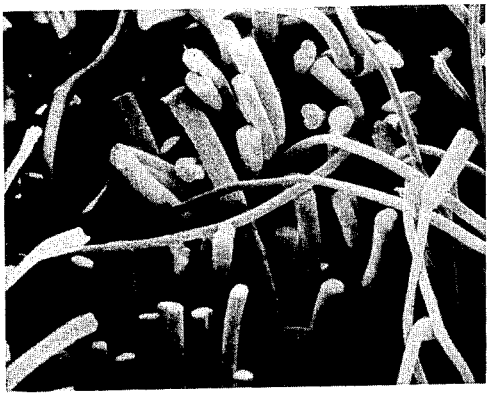

The visual effect of the treatment is shown in FIG. 16. Highly distinct and precisely defined grooves were permanently formed on the fabric surface, equivalent to those formed on melt spun thermoplastic yarn fabrics in prior Examples. FIG. 7 is a magnified view (100×) seen by a scanning electron microscope (SEM), of the untreated area. FIG. 18 shows a treated portion of the same fabric under equivalent SEM magnification, revealing the localized, dramatic thickening and shrinking of the acrylic pile fibers as a result of treatment. Several fibers on the edges of the treated area show where heated air has struck the top portion of the fiber, causing substantial localized shrinking only in that portion of the fiber. This localized shrinkage of portions of individual fibers has been observed frequently in the treatment of pile fabrics by the apparauts and process of this invention, particularly when grooves or other patterns of light or intermediate intensity are desired and the air temperature, pressure, and fabric speed are adjusted accordingly.

Figure 19:
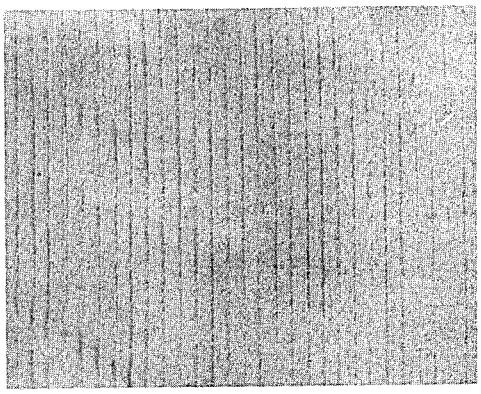
FIG. 19 is a photograph of the surface of a textile fabric product treated by a conventicnal process.
Figure 20:
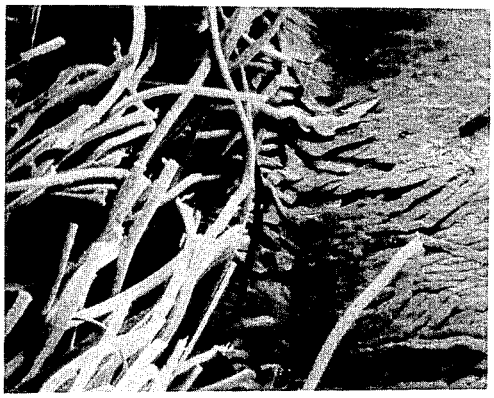
FIG. 20 is a photomicrograph of the fabric surface shown in FIG. 19.

For comparison purposes, FIG. 19 shows the overall surface effect and FIG. 20 shows an SEM-magnified view (100×) of an acrylic pile fabric, the surface of which has been embossed in a grooved pattern by conventional means using a heated roll. The treated portion appears on the right of FIG. 20. Substantial shrinkage of the acrylic fibers in the embossed areas is absent; the visual effect appears to be the result of the extreme compaction of the fibers by the roll, with a substantial loss of fiber integrity. When subjected to steam cleaning, or abrasion when wet, the compacted fibers tend to revert to their untreated state, and the embossed pattern becomes significantly less distinct.

To achieve temperatures sufficient to shrink substantially the fibers as is done in the present invention, it is believed the contact by the roll would cause the fibers to stick to the roll surface, resulting in a non-uniform appearance and a substantial detrimental change in the hand of the fabric in areas contacted by the roll. The fibers forming the backing of the fabric would also tend to change character and loose strength. These effects do not occur when the fabric is treated by the method and apparatus of the instant invention.

EXAMPLE 8

A knitted acrylic plush pile fabric as described in Example 7 was treated as in Example 7, except that the discharge channels formed in the slot were of rectangular cross-sectional dimension of 0.145 in. wide by 0.015 in. high. Highly distinct and precisely defined grooves were permanently formed by the shrunken pile fibers. The treated areas were substantially sunken, and generally darker in appearance, than the surrounding untreated areas. The fabric enjoyed the same advantages and general appearance as that of Example 7.

EXAMPLE 9

A knitted polyester interlock dyed fabric having a weight of approximately 4 ounces per square yard was treated on the apparatus of FIG. 1 under the following conditions: heated air temperature in manifold—630° F.; heated air pressure in manifold—2.3 p.s.i.g.; cool air pressure—11.5 p s.i.g.; manifold to fabric spacing—0.1 in.; fabric speed—5 yards/minute, 1% underfeed; and heated air discharge channel size—0.050 in. wide, 0.015 in. high (facing fabric).

Figure 21:
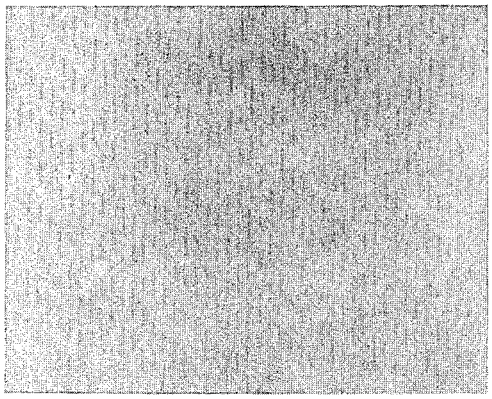
FIG. 21 is a photograph of the surface of a novel textile fabric product produced in accordance with the present invention.
Figure 22:
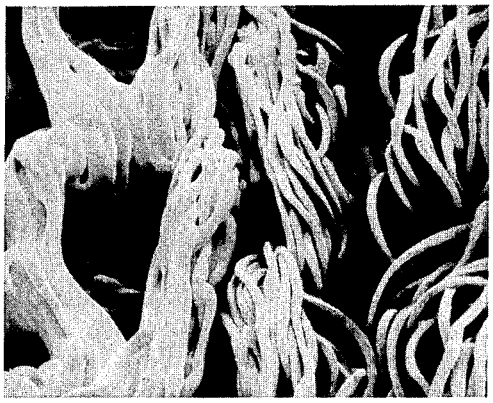
FIG. 22 is a photomicrograph of the fabric surface of FIG. 21.

The visual effect of the treatment, which is perceived at a distance as predominately a two tone effect rather than a grooving or texturing effect, is shown in FIG. 21. In this case, distinct and well defined patterns were formed on the fabric surface as a result of the previously directed streams of hot air causing dramatic shrinking accompanied by some fusing of the individual yarns, which can be seen in detail in the SEM-magnified view (100×) shown in FIG. 22 in which treated (left-hand side) and untreated (right-hand side) sections of fabric are compared. This view additionally demonstrates the precise pattern boundaries which are possible with the present invention.

A similar visual effect may be achieved under similar operating contions, where the fabric is undyed, and is dyed subsequent to treatment, as well as where the individual fibers or yarns are thermally shrunk without significant melting or fusing of the fibers by reducing the temperature of the heated air streams, reducing the heated air pressure, or increasing the relative speed of the fabric past the heated air stream. In many cases, prevention of significant fusing is preferred, due to the deleterious effect the fused fibers have on fabric hand and strength

EXAMPLE 10

A flat knitted dyed fabric comprising nylon and spandex and having a weight of approximately 4 ounces per square yard was treated using the apparatus and operating conditions of Example 9. The treated fibers were significantly darker than the surrounding untreated fibers, and had undergone substantial shrinking when compared with the untreated fibers. A precise, well-defined pattern was permanently imprinted on one surface of the fabric, without any noticeable effect on the reverse side of the fabric. There was no discernable change in the fabric hand. As in Example 9, if the fabric is undyed prior to treatment, a differential dye uptake effect is noted upon dyeing after treatment.

EXAMPLE 11

A knitted nylon pile fabric having a pile height of approximately 0.1 inch was treated on the apparatus of FIG. 1, but without a shim member, under the following conditions: heated air temperature in manifold—650° F.; heated air pressure in manifold—1 p.s.i.g.; cool air pressure—15 p.s.i.g.; manifold to fabric spacing—0.1 inch; fabric speed—3 yards/minute, 3% underfeed, and manifold slot height—0.01 inch.

Figure 23:
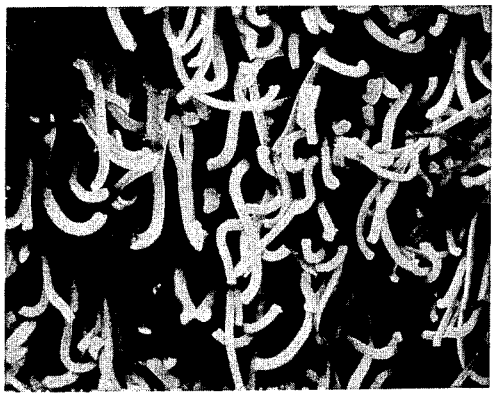
FIG. 23 is a photomicrograph of the treated surface portion of a nylon pile fabric produced in accordance with the present invention.
Figure 24:
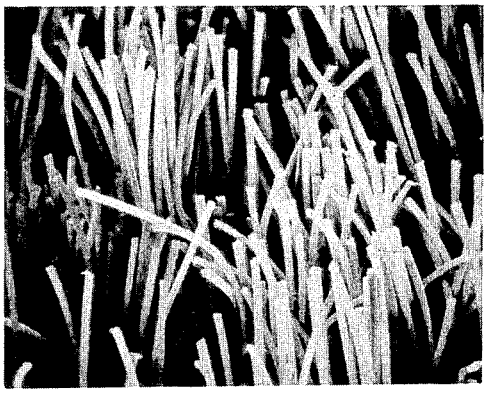
FIG. 24 is a photomicrograph of the untreated surface portion of the fabric of FIG. 23.

The resulting fabric product exhibited a sharply defined checker board-type pattern in which the fibers in the treated portions of the fabric, shown in a scanning electric micrograph (50×) in FIG. 23, were substantially and permanently shrunken, compacted and entangled when compared with the untreated portions of the fabric in a similar view shown in FIG. 24. Subjectively, the treated areas of the fabric appeared somewhat sunken, quite fuzzy and significantly less light reflective and visually darker than surrounding untreated fibers, the latter having a somewhat glossy luster and all appearing to be oriented in the same general direction. It is believed that the heated air causes a change in the cross-sectional shape as well as size of the fibers, thereby changing their individual light reflectivity.

EXAMPLE 12

Figure 25:
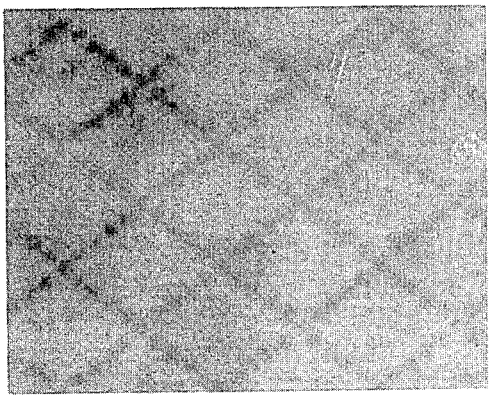
FIG. 25 is a photograph of the surface of a novel textile pile fabric produced in accordance with the present invention.

A polyester pile fabric having a pile height of approximately 0.08 inch was treated using the apparatus and operating conditions of Example 10. The resulting fabric product is shown in FIG. 25. A substantial lightening of the fabric in the treated areas (the interior of the large diamonds) resulted in a permanent two-tone design with negligible effect on fabric hand or surface contour.

In the foregoing specific Examples, it is believed processing speeds of the fabric through the apparatus may be increased by preheating the fabric prior to its passage by the heated air discharge manifold slot, or by increasing the temperature and/or air velocity of the heated air streams. Typically, the fabric may be preheated by infrared heaters of known type, and/or by heating support roll 16.

Although the foregoing Examples set forth typical operating conditions for treating textile pile fabrics and woven fabrics to impart visual surface changes and patterns thereto, it can be appreciated that the treating fluid, and the temperature and conditions of fluid treatment may be varied depending on the particular substrate construction, and the particular surface appearance to be imparted thereto. Excellent results in patterning of pile fabrics containing melt spun thermoplastic pile yarns have been achieved at processing speeds of approximately four to ten yards per minute, and with heated air temperatures at the heater exits of between 600°-850° F. and pressures of from about one to ten p.s.i.g. in the manifold compartment. Excellent results using pile fabrics containing solution spun thermoplastic pile yarns have been achieved at processing speeds of approximately two to ten yards per minute, heated air temperatures and pressures of between 600° and 900° F. and one to seven p.s.i.g., respectively, as measured in the manifold, and with a heated air discharge channel width of 0.050 in. or wider. Other values for these operating parameters may be advantageous under certain conditions. In general, higher pressures may be employed when the discharge slot or the channels formed therein are of smaller cross-seectional dimension. Channel or slot heights of about 0.007 to about 0.07 inch have been used. Also higher gas temperatures may allow higher processing speeds, and vice versa. Higher gas temperatures may also be desirable when use is made of cool pressurized gas to control the flow of the heated gas streams.

It is believed that so long as the individual fibers are raised to the appropriate requisite temperature, the fibers will become permanently thermally modified, if not constrained, by shrinking along their main axis, by substantially increasing in diameter, by forming more compact spun fiber bundles, and, in some cases, by changing fiber cross-sectional shape or configuration, or by melting. It was disclosed in commonly assigned U.S. patent application Ser. No. 103,329, that when certain fabrics, for example acrylic pile fabrics, were contacted by heated air streams, the air stream was successful in forming a groove in the fabric, but the definition of the groove was not as precise as that obtained with other materials, for example, polyester pile fabrics. It was further disclosed that when a textile material made from nylon 6,6 fibers, were similarly contacted with a heated air stream, no distinct groove was formed, even though another nylon containing fabric had been successfully treated. In light of the results disclosed herein, this behavior regarding acrylic and nylon 6,6-containing substrates is thought to be the result of failing to heat the subject fibers to a temperature necessary for sufficient thermally-induced physical modification, such as longitudinal shrinkage, to take place.

Figure 26:
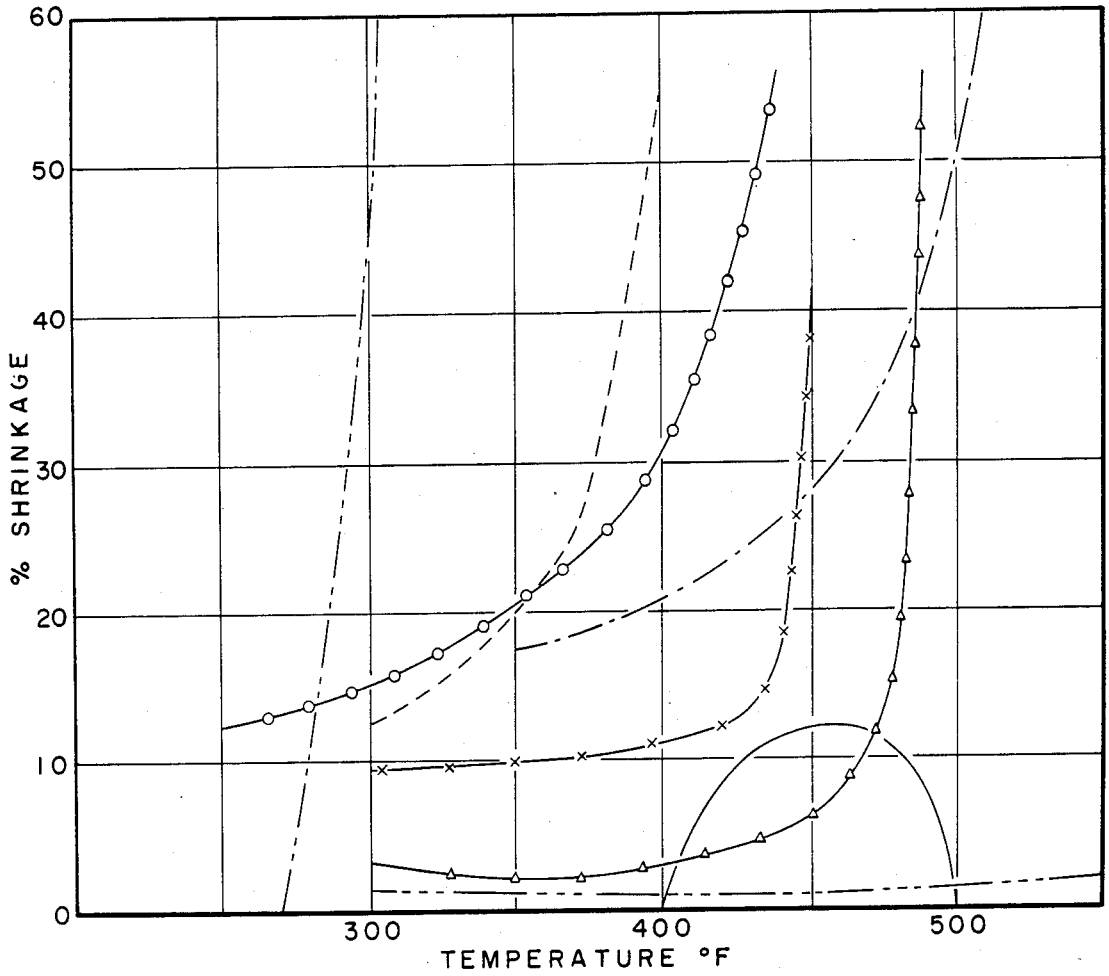
FIG. 26 is a diagram of experimentally determined shrinkages for various man-made fibers, shown as a function of temperature.

The graph depicted in FIG. 26 summarizes experimental results concerning the relationship between yarn temperature and resulting shrinkage for eight different fibers. These results were obtained by submersing a controlled length of yarn of a given type into a fluidized bed of sand particles heated to a uniform temperature. The length of a loop of the yarn sample was initially measured while the loop was supporting a five gram weight. The weight was removed, and the entire loop was submersed in the fluidized bed for five seconds. The yarn loop was removed, allowed to cool for approximately fifteeen seconds, the five gram weight was again applied, and the length of the loop measured. The percentage of shrinkage was calculated by dividing the change in length by the original length, and multiplying the result by a factor of one hundred. As can be seen from FIG. 26, the temperatures at which shrinkage of, say, thirty per cent or more may be expected is substantially different depending upon the fiber under consideration. Fibers comprising polyester, nylon 6, and polypropylene yarns exhibit such shrinkage at a substantially lower temperature than do yarns comprising acrylic fibers, nylon 6,6, and acetate. All fibers tested, except for rayon and, to a lesser extent, acetate, exhibited substantial shrinkage of thirty to fifty per cent or more, if heated to a sufficiently high temperature.

To substantiate the ability to alter and modify various substrate materials by application of pressurized heated fluid streams to selected areas of the substrate surface in accordance with the present invention, a number of substrates of varying constructions and composition were contacted by a stream of pressurized heated air directed thereinto from a fixed single jet orifice having a 0.03 inch diameter. The substrates were randomly moved adjacent the stream jet orifice under conditions of treatment set forth in the following table. Air temperature and pressure measurements were taken within the jet orifice.

TABLE I

| SUBSTRATE | AIR PRESS. PSI | AIR TEMP. °F. | DISTANCE FROM ORIFICE TO SUBSTRATE SURFACE |
|---|---|---|---|
| (1) woven fabric containing laminated pile-like surface of polyethylene filamentary material | 1 | 400 | 0.1" |
| (2) paper sheet containing laminated pile-like surface of polyethylene filamentary material | 3 | 350 | 0.1" |
| (3) needle-punched non-woven fabric of polypropylene filamentary material | 15 | 600 | 0.1" |
| (4) tufted polypropylene pile yarn fabric | 6 | 600 | 0.1" |
| (5) woven rayon plush pile fabric | 5 | 600 | 0.1" |
| (6) spun bonded nylon 66 fabric (1 oz/yd$^2$) | 6 | 600 | 0.1" |
| (7) woven nylon 6 fabric (1.6 oz/yd$^2$) | 11 | 760 | 0.1" |
| (8) woven nylon 6,6 fabric (1.6 oz/yd$^2$) | 11 | 760 | 0.1" |
| (9) flat knitted acrylic fabric | 11 | 950 | 0.1" |
| (10) woven acetate fabric (2 oz/yd$^2$) | 11 | 900 | 0.1" |
| (11) tufted triacetate fabric (4.5 oz/yd$^2$) | 11 | 760 | 0.1" |
| (12) flexible polyurethane foam | 11 | 600 | 0.1" |
| (13) rigid polystyrene foam | 11 | 600 | 0.1" |
| (14) polyvinyl chloride carpet backing | 11 | 600 | 0.1" |
| (15) neoprene foam | 11 | 600 | 0.1" |

Visual observation of the substrate treated under the conditions defined above indicated that a narrow groove was formed in the surface areas of substrates 1–5 and 7–15 contacted by the heated air stream.

In substrate 6, above, the conditions of air stream treatment cut entirely through the substrate, indicating that the present invention can also be employed to produce lace effects in sheet material substrates and fabrics.

By use of the apparatus and methods of the present invention, it can be seen that surface modification of thermoplastic fiber and yarn containing textile fabrics, as well as other substrates, can be effected to impart precise, well defined and intricate patterns and surface appearances thereto.

I claim:

1. A textile pile fabric having a patterned surface appearance in the pile surface thereof, said fabric comprising thermoplastic pile yarns having generally similar thermal shrinkage characteristics, certain of said pile yarns being substantially thermally longitudinally shrunken and compacted into the pile surface below the height of adjacent pile yarns to form grooves in the pile surface, at least some of said shrunken pile yarns exhibiting localized shrinking near the top portion of the yarn, and adjacent said pile yarns which form edge portions of the grooves being generally unshrunken, undisturbed, and upright to provide sharp boundary definition to said narrow grooves.

2. A fabric as defined in claim 1 wherein said pile yearn weight per unit of surface area is generally uniform throughout the fabric.

3. A fabric as defined in claim 1 wherein said grooves are discontinuous along one direction in the pile fabric.

4. A fabric as defined in claim 1 wherein said fabric is comprised of melt spun thermoplastic pile yarns.

5. A fabric as defined in claim 1 wherein said fabric is comprised of solution spun thermoplastic pile yarns.

6. A fabric as defined in claim 1 wherein said grooves are intersecting grooves.

7. A fabric as defined in claim 1 wherein said grooves define closed boundaries completely surrounding areas wherein at least some of said pile yarns are generally unshrunken, undisturbed, and upright.

8. A woven textile fabric having a crepe surface pattern appearance, said fabric comprising thermoplastic yarns of substantially uniform thermal shrinkage characteristics, spaced groups of adjacent yarns extending along one yarn thread direction of the fabric being longitudinally thermally shrunk along at least portions of their length, with said adjacent yarns in other portions of said fabric being substantially longitudinally unshrunk to produce a crepe appearance in the fabric.

9. A fabric as defined in claim 8 wherein said spaced groups of yarns are continuously thermally shrunk along their length.

10. A knitted textile fabric having a crepe surface pattern appearance, said fabric comprising thermoplastic yarns of substantially uniform thermal shrinkage characteristics, and further comprising spaced groups of yarns which are longitudinally thermally shrunk, and wherein groups of yarns adjacent to said spaced groups are substantially longitudinally unshrunk to produce a crepe appearance in the fabric.

11. A textile fabric carrying a multi-tone surface pattern on one surface thereon, said fabric comprising thermoplastic yarns of substantially uniform thermal shrinkage characteristics, at least a portion of said yarns within an area comprising said pattern exhibiting shrinkage near the top portion of the yarn compared with said yarns outside said area comprising said pattern, said shrunken yarns appearing visually darker than said yarns outside said pattern area.

12. A fabric as defined in claim 11 wherein the fabric surface opposite that carrying said surface pattern is free of said surface pattern.

* * * * *